United States Patent [19]

Lutgen et al.

[11] Patent Number: 4,848,751

[45] Date of Patent: Jul. 18, 1989

[54] LANCE FOR DISCHARGING LIQUID NITROGEN OR LIQUID ARGON INTO A FURNACE THROUGHOUT THE PRODUCTION OF MOLTEN METAL

[75] Inventors: Noël F. Lutgen, Igny, France; Sara Hornby-Anderson, Westmont, Ill.

[73] Assignee: L'Air Liquide, Paris, France

[21] Appl. No.: 103,028

[22] Filed: Sep. 30, 1987

Related U.S. Application Data

[63] Continuation-in-part of Ser. No. 77,168, Jun. 24, 1987, Pat. No. 4,806,156.

[51] Int. Cl.[4] ..... C21C 7/00

[52] U.S. Cl. ..... 266/44; 266/207; 266/225; 266/270; 266/220

[58] Field of Search ..... 266/207, 220, 225, 270, 266/44; 75/96

[56] References Cited

U.S. PATENT DOCUMENTS

| | | | |
|---|---|---|---|
| 3,400,752 | 9/1968 | Unsworth | 75/96 |
| 4,089,678 | 5/1978 | Hanawalt | 75/96 |
| 4,236,913 | 12/1980 | Austin | 75/10.44 |
| 4,657,587 | 4/1987 | Savard et al. | 75/96 |

FOREIGN PATENT DOCUMENTS

| | | | |
|---|---|---|---|
| 20369 | 2/1983 | Japan . | |
| 22340 | 2/1983 | Japan | 75/96 |
| 220279 | 2/1925 | United Kingdom | 266/225 |
| 987190 | 3/1965 | United Kingdom . | |

OTHER PUBLICATIONS

French Research Disclosure No. 26063, Dec., 1985.

Japanese Abstract No. 60-61148, Apr., 1985, vol. 9, No. 198, Aug. 15, 1985.

*Primary Examiner*—Robert McDowell

*Attorney, Agent, or Firm*—Lee C. Robinson, Jr.

[57] ABSTRACT

Liquid argon or nitrogen is poured with a lance into a furnace during the production of molten metal.

According to the invention, the lance comprises a double wall in which a hole is respectively located in order to vent the argon or nitrogen gas to reduce the rate of diphasic. The tip of the lance is equipped with a diffuser to improve the liquid discharge.

14 Claims, 3 Drawing Sheets

LANCE FOR DISCHARGING LIQUID NITROGEN OR LIQUID ARGON INTO A FURNACE THROUGHOUT THE PRODUCTION OF MOLTEN METAL

This is a continuation in part of Ser. No. 077168 filed on July, 24, 1987 U.S. Pat. No. 4,806,156.

BACKGROUND OF THE INVENTION

1. FIELD OF THE INVENTION

The invention relates to the production of a bath of molten metal or alloys wherein liquid nitrogen or argon is discharged throughout the process of the production of molten metal or alloys and more particularly to a lance for discharging the said liquid gas.

2. PRIOR ART

It is known from British Patent 987 190 to cast continuously a molten metal from a ladle into an ingot mould and to shield the jet of molten metal with a solidified or liquefied inert gas such as liquid nitrogen (when the presence of this element in the metal is not harmful) or argon along with the surface of molten metal in said ladle to avoid oxygen, hydrogen and nitrogen pick-up from the surrounding atmosphere.

In electrical furnaces, milten metal comes from the heating up of pieces of metal or of scrap metal which are progressively melted in said furnace, while new pieces of metal or scrap metal are added throughout the melting phase.

Almost any open face surface of hot solid or molten metal can be protected against oxygen, hydrogen and-/or nitrogen pick-up by injection of liquid argon or nitrogen (if nitrogen pick-up is not a problem) above the said surface. Said process makes it possible to prevent contamination from not only atmospheric oxygen but also from humidity generating hydrogen in the melt or from nitrogen in as much as liquid nitrogen is not used.

Furthermore, it is possible with such a process to protect the pieces of scrap metal or new stocks of metal in the stage of pre-heating above the liquid bath of molten metal prior to melting. The atmosphere above the metal is selected according to the nature of metals, alloyed metals, alloys or pure metals and it must be maintained above and around the elements of the charge throughout the whole melting and holding operations, from the very moment the charge begins to heat up, up to the moment the metal is tapped.

Contrary to the shielding of the surface of the metal, preheated, solid or liquid with argon or nitrogen in gaseous state, where the injection velocity of said gases creates turbulence and hence an ingress of atmospheric air diluting the inert atmosphere, protection of the surface of the metal surface with liquefied gas makes it possible for said liquefied gases to reach the bottom of the furnace or the surface of the molten metal : they first vaporize as cold heavy gases (which are heavier than the same at room temperature) which in turn, heat-up, expand and flush out all the atmospheric air in the furnace.

However, there are some limitations to this protection against hydrogen, nitrogen and/or oxygen pick-ups.

When the pieces of metal are partly covered by water, this water can come into contact with the molten bath and generate hydrogen bubbles in the bath along with some metal oxides. Hydrogen can also be generated by the flames of the burners, if any are used to heat the molten metal. Oxygen can be generated from deeply oxidized metal scrap introduced in the bath and nitrogen can be generated from nitrogen in the alloying elements namely in arc furnaces in the region of electrodes.

When, according to the process disclosed in the copending application Ser. No. 077168 filed on July, 24, 1987 U.S. Pat. No. 4,806,156, liquid nitrogen or liquid argon is poured into the furnace during the production of molten metal, it is necessary for the level of diphasic argon or nitrogen to be as low as possible : the inventors discovered during their experiments that the presence of nitrogen or argon gas in the lance used to deliver the liquid gas generates turbulences in said lance and thus some splashes occured in the molten metal which could be very dangerous for people present in the vicinity of the furnace. It also destroys the inert atmosphere due to the pulsating flow, which provides non maintenance of liquid in the furnace or on the metal surface and an ingress of air due to gas velocity.

SUMMARY OF THE INVENTION

Accordingly, it is an object of the present invention to provide a lance for preventing splashes in a bath of molten metal, and/or maintaining a continuous flow to ensure an inert atmosphere is retained when liquid nitrogen or argon is poured into a furnace during the production of said molten metal.

Another object of the invention is to provide a lance which is self degassing, i.e. where about no gas reaches the tip of the lance where liquid gas is poured.

A further object of the invention is to provide a lance for discharging liquid nitrogen or argon throughout molten metal or alloy production, said lance being provided with self-degassing means to discharge about only liquefied gas from the lance throughout the molten metal or alloy production. This lance is designed to prevent any fluctuation phenomena due to the diphasic state of the fluid within the lance submitted toheat radiated by the furnace or the metal containing vessels or the hot or molten metal contained therein during the different steps of the process.

The lance, according to the invention, is able to deliver a calm flow of liquid which makes it possible to control the volume of liquid flowing out of the liquefied gas container with a simple pressure gauge. At this point of the feed line, at the very outlet of the tank, the state of the liquefied gas is mono-phasic (liquid) and can be measured as such. A given installation can be calibrated once and for all for a given liquid gas : the flow-rate is a function of the pressure of said liquid.

According to the invention there is provided a lance for discharging liquid nitrogen or argon above a furnace throughout the production of molten metal or alloy, said lance comprising a first cylindrical body having first and second ends, connector means connected to said first end of said first cylindrical body, and adapted to be connected to a storage vessel containing said liquid argon or nitrogen, diffusor means connected at said second end of said first cylindrical body adapted to discharge said liquid argon or nitrogen, a second cylindrical body comprising first and second ends, said second cylindrical body coaxially surrounding at least a port of said first cylindrical body, first and second end flanges respectively positioned on each end of said second clylindrical body and defining between said first and second cylindrical bodies a hollow chamber, said first cylindrical body comprising a first hole and said second cylindrical body comprising a second hole close to said first end flange, said holes being adapted to vent nitrogen or argon gas without substantially disturbing the flow of liquid nitrogen or argon.

According to a preferred embodiment of the invention, the diameter of the hole in the first cylindrical body is smaller than that in the second cylindrical body. The area ratio between these holes will be at most 0.5 and preferably about 0.25. The larger hole in the second cylindrical body will be preferably located in the vicinity of the first end flange and in the vicinity of said first end of said first cylindrical body, while the smaller hole is preferably located opposite in said hollow chamber, both holes being located in the top walls of said bodies when said lance is oriented as it must be during the pouring operation.

BRIEF DESCRIPTION OF THE DRAWINGS

Other and further features of the invention will be clearly understood by reference to the following description of various embodiments of the invention chosen for purpose of illustration only, along with the claims and the accompanying drawings, wherein:

DESCRIPTION OF THE PREFERRED EMBODIMENT

Figure 1:
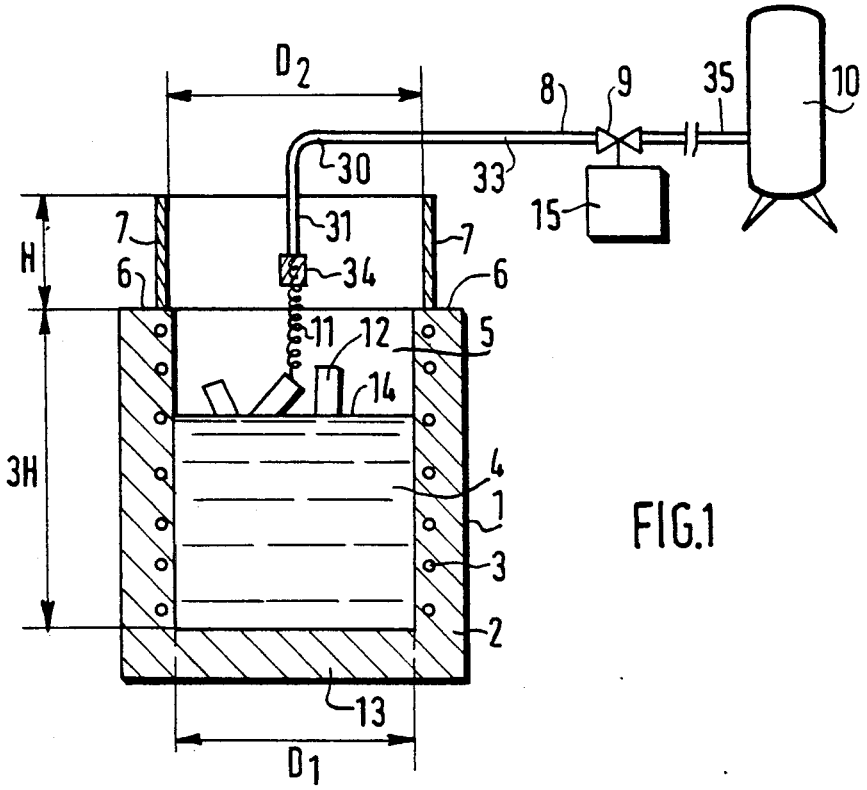
FIG. 1 is a schematic view, partially in cross section of an installation using an induction furnace according to the invention.

FIG. 1 shows a schematic view of an induction furnace 1 of cylindrical shape (having an internal diameter D1). In the vertical wall 2 of the furnace 1 (having a bottom wall 13) are embedded electrical conductors, helicoidally wound 3, to heat the bath of metal 4 by induction currents wherein some scraps of metal 12 (or new stocks) are not yet molten. The top rim 6 of the lateral wall 2 of the furnace bears a cylindrical sheath 7 made of an appropriate metal or the like. The internal diameter D2 of said sheath is slightly greater than the internal diameter D1 of the furnace 1. An L - shaped lance 8 with a vertical portion 31 approximately arranged along the longitudinal axis of the cylindrical sheath 7 and a horizontal portion 33 connected through the valve 9 and the flexible hose 35 to the liquid argon, or nitrogen storage vessel 10, said portions being connected together by an elbow portion 30, is used to dispense inert liquid 11 like argon or nitrogen onto the surface 14 of the molten bath. The cylindrical sheath 7 has a height H which is about one third of the depth of the furnace, from the rim 6 to the inner surface of the bottom wall 13.

The inventors recognized that when the surface 14 of the molten metal 4 reaches beyond about the two thirds of the total depth of the furnace, oxygen concentration in the atmosphere 5 above the molten bath dramatically increases whatever the flowrate of inert liquid 11 onto the surface 14. They also recognized this concentration can be maintained about within the same range as before said molten metal reaches about the two thirds of the depth of the furnace by setting a cylindrical sheath 7 on the rim 6 of the furnace, said sheath surrounding the tip of the lance 8. This sheat must be set no later than when the two-thirds of the furnace are filled and preferably as soon as liquid injection begins. When the flowrate of the inter liquid increases along with the introduction of metal in the furnace (this flowrate varies between about 0.006 and 0.017 lb/square inch of exposed metal surface area in the furnace or an approximate total liquid consumption of 0.025 to 0.060 lb/cu.inch of metal in the furnace), valve 9 can be equipped, if necessary, with a well known regulation device 15 of the type incresing said flowrate when the level of molten metal in the furnace increases. But it is also easy to have a manual valve with a pressure gauge (not represented on the figure) to control the flowrate of the inert liquid, increasing said flowrate within the above defined range or maintaining it within said range at a value corresponding to a furnace full of metal.

Figure 2:
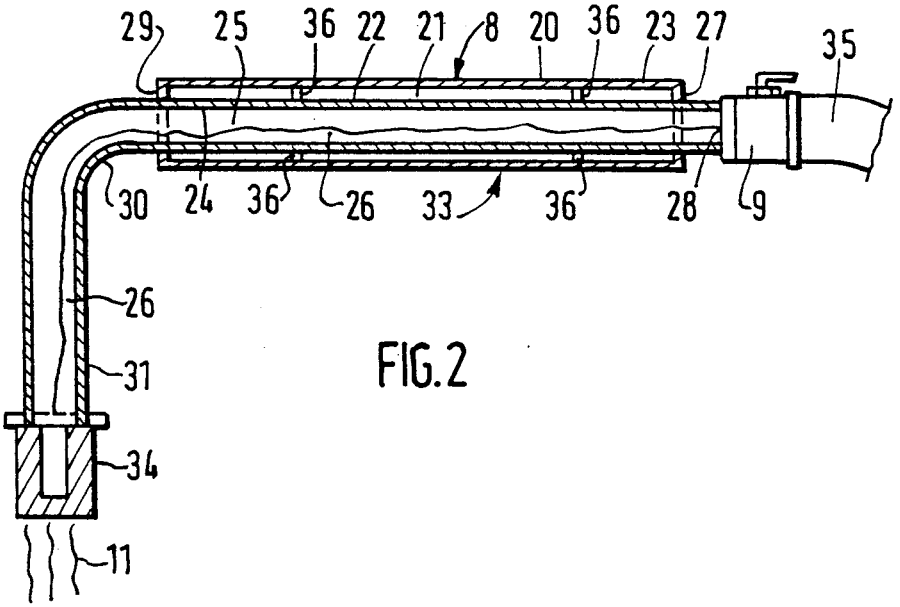
FIG. 2 is a cross section view of a first embodiment of a lance according to the invention.

FIG. 2 shows an example of a first embodiment of a lance used to discharge inert liquid during molten metal production. The lance 8 comprises a first cylindrical body 22 and a second cylindrical body 20, coaxial with the first one and surrounding partially the same on about the whole longitudinal portion 33 of the lance 1. The first cylindrical body 22 is extended by a curved portion of an elbow 30, on its upstream end, which, inturn is prolonged by an about vertical portion 31 of said lance extending about along the vertical axis of said furnace 1 (FIG. 1). A first end 28 of said first cylindrical body 22 is adapted to be connected to the vessel 10 by means of a valve 9 and a flexible hose 35. The second cylindrical body comprises two end flanges, a first one 27 located up-stream near the valve 9 and a second one 29 located downstream near the elbow 30. The two cylindrical bodies 20 and 22 along with the two end flanges 27 and 29 define a hollow chamber 21, having a first hole 24 close to the end flange 29, on the top of said first body 22 and a second hole 23 close to the end flange 27, on the top of said second body 20. Tabs 36 are connected to both cylindrical bodies to maintain their coaxial alignment. A diffuser 34 is connected at the lower end of the vertical portion 31 of said lance.

When the inert liquid flows (horizontally in FIG. 2) inside said first cylindrical body 22, inert gas vaporzied from said inert liquid 26 can escape through the hole 24 and flows counter-flow to the liquid in the hollow annular space 21 defined between said first and second cylindrical bodies. Said inert gas, which is cold, escapes through the port 23 after flowing around the said second cylindrical body, thus maintaining the cold temperature of the first cylindrical body. Furthermore this cold gas cools the sheath 20 of the lance 8 (second cylindrical body) allowing said lance to withstand the heat generated by the bath of molten metal when it is used according to FIG. 1. This lance reduces the incidence of water condenstation falling on the molten bath with the risk of generating hydrogen by heat decomposition of the water.

The distance between the lower end of the diffuser and the surface of molten metal will be maintained as small as possible, particularly when there is more than two-thirds of metal in the furnace. This distance, smaller than the distance between the top end of the skirt and the level of molten metal, will be preferably maintained between about 1 and 4 inches.

Figure 3:
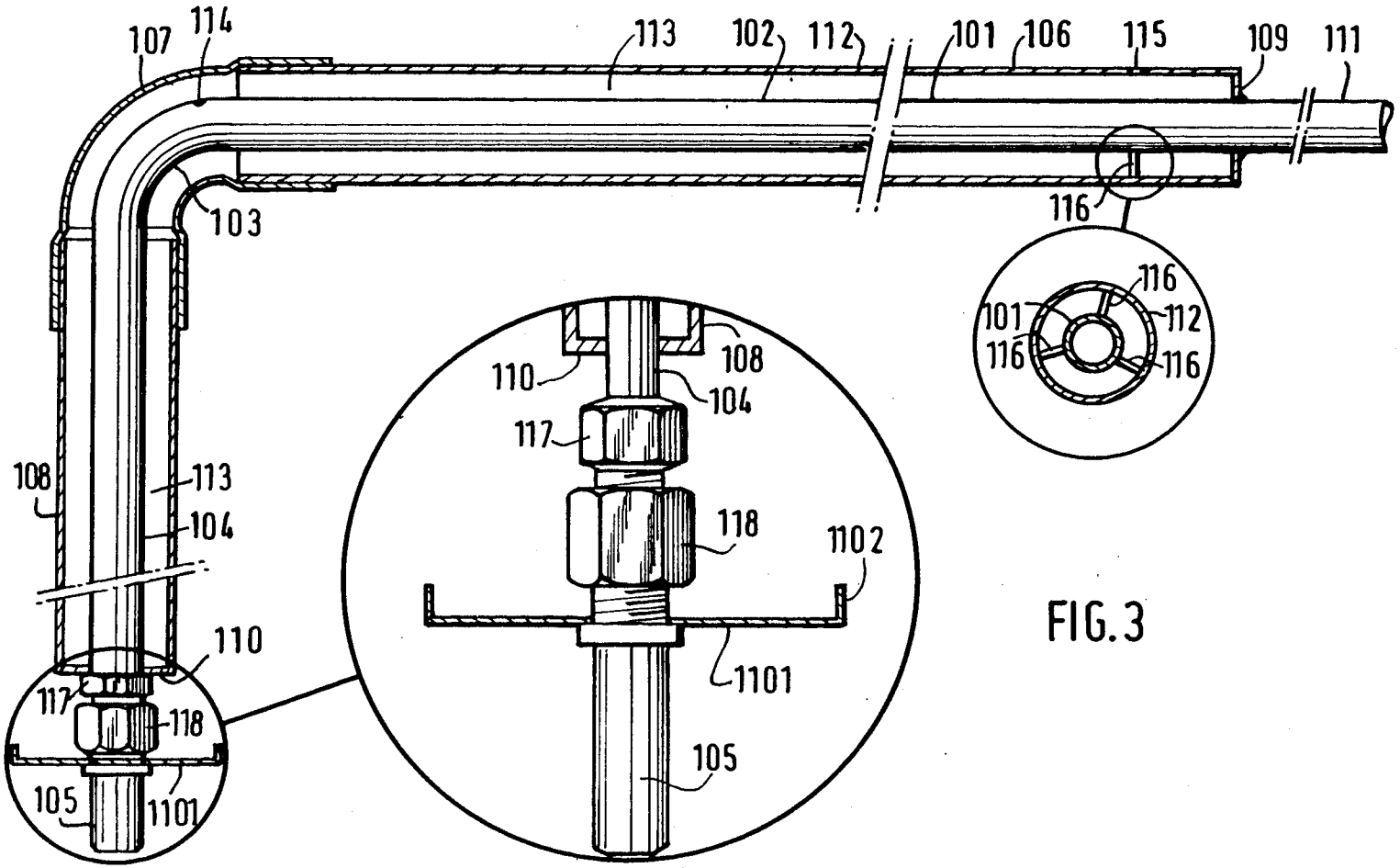
FIG. 3 is a cross section view of a preferred embodiment of a lance according to the invention.

FIG. 3 is a view of the preferred embodiment of the lance according to the invention. It comprises a first cylindrical body 101 having a first, about horizontal, portion 102, a curved portion 103 and then a second, about vertical, portion 104 at the end of which is screwed a diffusor 105, having, for example, holes of 40 microns diameter. This first cylindrical body is surrounded by a second cylindrical body 112 having a first about horizontal portion 106, a curved portion 107 and an about vertical portion 108, all portions respectively coaxially surrounding the corresponding portions of said first cylindrical body. In both ends, said second cylindrical body comprises end flanges 109, 110 defining a hollow cylindrical chamber 113 between the inner wall of said second cylindrical body and the outer wall of said first cylindrical body. Spacer means 116 are provided between said first and second cylindrical bodies to maintain them in coaxial alignment, end flanges 109 and 110 also maintaining said coaxial alignment. The first cylindrical body comprises an inner vent hole 114 at the end of said first portion 102, located near the connection between said first portion 102 and said curved portion 103. The second cylindrical body comprises an outer vent hole 115 located near the end flange 109. The area ratio between said inner and said outer vent holes is about 0.5. The end flange 110 is as close as possible to the stainless steel diffuser 105 connected to the first cylindrical body 104 by a female connector 118 and a compression nut 117. A drip washer 1101 having a diameter about 5 to 10 times the diameter of said first cylindrical body 104 is set between the diffuser 105 and the female connector 118 to vaporize water generated by condensation on the lance when radiating heat from the metal bath is not sufficient to keep the lance above freezing temperature. This circular drip washer 1101 may comprise, if necessary, a rim 1102 along the circumference if the conditions are such that a lot of water is generated and there is a risk that such water falls in the bath of molten metal.

Figure 4:
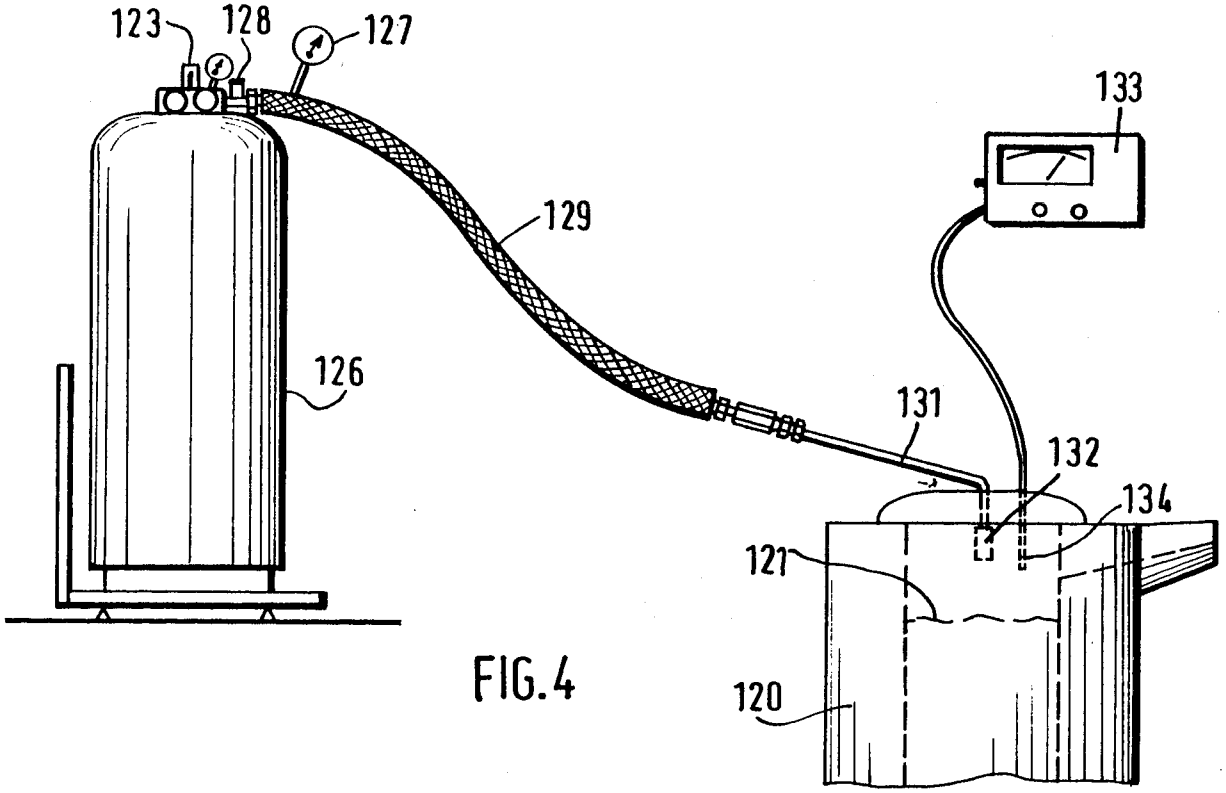
FIG. 4 is a schematic view of a test installation using the lance.

The way of using the lance to inert a bath of molten metal will now be explained with reference to FIG. 4. The lance is preferably set about horizontally, the diffuser 132 being a few inches above the molten metal fill level. A pressure relief valve 128 is connected to the output of the liquid argon cylinder 126 just after the flowrate command valve 123 and then to one end of a cryo-hose 129. The opposite end of the hose 129 is connected to the lance 131 having a diffusor 132 at the tip thereof. An oxygen probe 134 controls the oxygen level by means of an oxygen analyzer 133. A gauge 127 is provided in the cryo-hose 129 to indicate the pressure of argon or nitrogen in said hose.

The pressure flow control of the liquid argon and thus the flowrate of liquid argon is very reliable. This system does not measure the liquid flowrate at the tip of the lance, but at the liquid outlet of the cylinder just before the flexible hose going to the lance. The lance can be calibrated either for nitrogen or for argon. Flows slightly differ between nitrogen and argon. The flowrate of liquid is a function of the pressure of the liquid in the cylinder, the diameter of the Tee junction between the cylinder 126 and the flexible hose 129 and the opening of the command valve 123.

The lance line, having stabilized in temperature allows monophasic liquid flow. Indications shown by the gauge 127 are remarkably steady, yet the gauge needle can be animated by very short span strokes that are due to the liquid out of measuring assembly tending toward the di-phasic state. The lance and its hole system helps separate the phases, as does the diffuser which is really a phase separator.

If during operations the pressure on the gauge rises and fluctuates, no pressure setting needs to be done but instead the diffuser has to be moved higher up above metal bath, variations in pressure (up) meaning that the diffuser is too close to heat source and acts as a vaporizer which builds-up a back-pressure.

During operation of the lance, the gas phase escapes through the hole 24 (FIG. 2) or 114 (FIG. 3) and the hollow chamber 21 or 113 is rapidly filled with cold gas which flushes out air at ambient temperature at the beginning of the operation of the lance, through the hole 23 or 115. The inner sleeve 22 or 102 is thus rapidly cooled by the cold gas thus reducing the vaporization of the liquid phase flowing in said inner sleeve. This is why the lance according to the invention makes it possible that less or about no turbulences occur in the liquid flow which is a condition for inerting the bath of molten metal efficiently.

Comparative Examples

The furnace is charged at intervals as the metal melts. The charge for a ferrous alloy is usually made of returns (gates, risers) discarded castings, ferrous scrap, ferro-alloys, virgin metal, etc. If the metal melted is non-ferrous, the charge will also be made of returns (gates, risers), discarded castings, non-ferrous scrap, alloying elements, virgin ingots of a known analysis, etc. The "cold-charge" is of course bulky and cannot be introduced in the furnace at once, in its entirety. The furnace thus is loaded with whatever can be put in to fill it and recharged at variable intervals as the charge "melts down". This operation goes on until the furnace is full of molten metal. Usually alloying elements are added last. The metal is introduced by hand, electro-magnet devices, bucket conveyors and similar equipment.

The liquified gas is introduced in the furnace a few minutes after starting to charge the same when said charge begins to get hot and thus when enough heat is present to vaporize the liquid gas. There is no need to introduce liquid nitrogen or argon into a cold furnace where it would accumulate onto the bottom for no practical purpose. Furthermore, an accumulation of cold liquified gas on the bottom could be detrimental to the lining.

On the top rim of an induction furnace having a circular open end of 18 inches and a depth of 24 inches was placed a skirt or cylindrical sheath of 8 inches height and 24 inches diameter. A flowrate of liquid argon of 2.5 lb/mn at 3 Psig was poured into the furnace as soon as the charge became hot until the furnace was full, the diffuser being at a distance of about 3 inches. Up to half of the furnace depth, the oxygen content above molten metal was less than 1%, then 1.5% at two-thirds of the depth and 3.0% when the furnace was full.

The same measurements were made in the same conditions and same metal bath but without said skirt. When the furnace was one-third full, the oxygen content was about 1.0%, then 1.5% at about half full and then about 3.0% at two-thirds of the depth, reaching 6.0% when the furnace was full.

By using the above disclosed lance and related method, not only oxygen and nitrogen pick-up were reduced (in this latter case, by using an inert gas which is not nitrogen), but also hydrogen pick-up from the atmosphere.

Also according to the invention, continuously pouring or discharging a liquid inert gas onto the surface of the melt, namely at the time alloying elements are added to said melt, drastically reduces hydrogen pick-up, the sample taken showing the metal to be ready for casting without a degassing step. This was particularly true for aluminium, copper and their respective alloys.

Furthermore for aluminium alloys, liquid argon or nitrogen advantageously replaced chloride and fluoride fluxes during melting while reducing non metallic inclusions (cleaner metal), incresing tensile strength and elasticity, improving flowability, increasing metal temperature without metal losses (about 300° F.), and allowed the melt to be held for a prolonged time at temperature with reduced metal losses. For copper and copper alloys, an increased flowability has been noticed, along with less slag and rejections and better surface quality.

For a Copper-Berylium alloy, the increase of beryllium recovery was from 40% to 91%.

Zinc alloys protected according to the invention before casting show more homogenous zinc dispersion while nickel and cobalt alloys show an increased fluidity, a reduced hydrogen pick-up with little or no slag formation and cleaner metal.

Steels have shown reduced slag formation, increased fluidity, reduced hydrogen pick-up and increased elongation and yield strengths.

In all cases increased fluidity permits either the lowering of the metal tap temperature if no pouring related problems are being experienced (by up to 150° F.) or the reduction of mis-runs or other pouring temperature related problems.

We claim:

1. A lance for discharging liquid nitrogen or argon from a storage vessel to above a furnace throughout the production of molten metal or alloy, said lance comprising a first cylindrical body having first and second ends, connector means connected to said first end of said first cylindrical body for connecting said first end to said storage vessel containing said liquid argon or nitrogen, diffuser means connected at said second end of said first cylindrical body for discharging said liquid argon or nitrogen, a second cylindrical body comprising first and second ends, said second cylindrical body coaxially surrounding at least a part of said first cylindrical body, first and second end flanges respectively positioned on each end of said second cylindrical body and defining between said first and second cylindrical bodies a hollow chamber, said first cylindrical body comprising a first hole located within said chamber and said second cylindrical body comprising a second hole located close to said first end flange, such that said holes vent nitrogen or argon gas without substantially disturbing the flow of liquid nitrogen or argon.

2. A lance according to claim 1 wherein the diameter of the first hole is smaller than that of the second hole.

3. A lance according to claim 1 wherein the area ratio between the first and second holes is smaller than 0.5.

4. A lance according to claim 1 wherein the area ratio between the first and second holes is about 0.25.

5. A lance according to claim 1, wherein said second hole is located near said first end of said first cylindrical body.

6. A lance according to claim 1, wherein said first cylindrical body comprises a longitudinal portion connected to said connector means, a curved portion connected to said longitudinal portion and an about vertical portion having an upper end connected to said curved portion and a lower end connected to said diffuser means.

7. A lance according to claim 6, wherein said second cylindrical body extends over about all the length of the rectilinear portion of said first cylindrical body.

8. A lance according to claim 6, wherein said second cylindrical body extends over about all the length of the first cylindrical body.

9. A lance according to claim 6, wherein said second cylindrical body extends almost to the second end of said first cylindrical body.

10. A lance according to claim 6, wherein said curved portion is oriented downward while said holes are located in the upward area of the walls of said first and second cylindrical bodies.

11. A lance according to claim 6, wherein said lance further comprises a washer between the diffuser and the second end of said first cylindrical body.

12. A lance according to claim 11, wherein said washer has a diameter between about 5 to 10 times the diameter of said first cylindrical body at said second end.

13. A lance according to claim 11, wherein said washer further comprises a rim around said washer's circumference.

14. A method for discharging liquid nitrogen or argon from a storage vessel to above a furnace throughout the production of molten metal or alloy, said method comprising discharging said liquid nitrogen or argon through a lance having a first cylindrical body having first and second ends, connector means connected to said first end of said first cylindrical body for connecting said first end to said storage vessel containing said liquid argon or nitrogen, diffuser means connected at said second end of said first cylindrical body for discharging said liquid argon or nitrogen, a second cylindrical body having first and second ends, said second cylindrical body coaxially surrounding at least a part of said first cylindrical body, first and second end flanges respectively positioned on each end of said second cylindrical body and defining between said first and second cylindrical bodies a hollow chamber, said first cylindrical body having a first hole located within said chamber and said second cylindrical body having a second hole located close to said first end flange, such that said holes vent nitrogen or argon gas without substantially disturbing the flow of liquid nitrogen or argon.

* * * * *